US005819711A

United States Patent [19]

Motose

[11] Patent Number: 5,819,711

[45] Date of Patent: Oct. 13, 1998

[54] VAPOR SEPARATOR FOR FUEL INJECTED ENGINE

[75] Inventor: Hitoshi Motose, Hamamatsu, Japan

[73] Assignee: Sanshin Kogyo Kabushiki Kaisha, Hamamatsu, Japan

[21] Appl. No.: 534,706

[22] Filed: Sep. 27, 1995

[30] Foreign Application Priority Data

Sep. 27, 1994 [JP] Japan ..... 6-231585
Sep. 27, 1994 [JP] Japan ..... 6-231586

[51] Int. Cl.[6] ..... F02M 37/04

[52] U.S. Cl. ..... 123/516; 123/509; 123/456

[58] Field of Search ..... 123/516, 514, 123/509, 456

[56] References Cited

U.S. PATENT DOCUMENTS

| | | | |
|---|---|---|---|
| 4,794,889 | 1/1989 | Hensel | 123/514 |
| 5,309,885 | 5/1994 | Rawlings | 123/509 |
| 5,341,842 | 8/1994 | Chih | 123/516 |
| 5,368,001 | 11/1994 | Roche | 123/516 |
| 5,389,245 | 2/1995 | Jaeger | 123/514 |
| 5,404,858 | 4/1995 | Kato | 123/516 |
| 5,501,202 | 3/1996 | Watanabe | 123/509 |
| 5,535,724 | 7/1996 | Davis | 123/516 |
| 5,579,740 | 12/1996 | Cotton | 123/516 |

*Primary Examiner*—Carl S. Miller
*Attorney, Agent, or Firm*—Knobbe, Martens, Olson & Bear LLP

[57] ABSTRACT

A fuel injection system for an internal combustion engine and particularly an outboard motor. The system includes a fuel vapor separator that is disposed on one side of the throttle bodies at the front of the engine. The fuel vapor separator is comprised of a housing assembly having a cover plate in which an integral fuel inlet fitting, an integral fuel outlet fitting, an integral vent fitting and an integral fuel return fitting are formed. The fuel injectors for the engine are disposed on the opposite side of the throttle bodies from the fuel vapor separator and are supplied with fuel through a vertically extending fuel rail. The pressure regulator is positioned at the top of the fuel rail and the fuel rail is directly affixed to the throttle bodies.

23 Claims, 9 Drawing Sheets

VAPOR SEPARATOR FOR FUEL INJECTED ENGINE

BACKGROUND OF THE INVENTION

This invention relates to a fuel injection system for an engine and more particularly to an outboard motor fuel injection system including a vapor separator.

The advantages of utilization of fuel injection for better fuel economy, emission control and better overall engine performance are well known. In some regards, fuel injection systems are less complicated than carbureted, charge forming systems. However, the fuel injection system preferably includes a number of components which may not necessarily be employed with carbureted engines.

For example, fuel injection systems normally employ, in addition to the low pressure fuel pump, a high pressure fuel pump. Coupled with this is the necessity of providing a pressure regulator for maintaining the desired pressure at the fuel injectors. In addition, vapor separators are also employed for purging the system of fuel vapors or air. Frequently, these vapor separators comprise a housing assembly that forms a chamber in which the fuel is delivered, and the level of fuel in the chamber is maintained by a float operated valve. The area above the fuel is vented in an appropriate manner so as to avoid emission of the fuel vapors to the atmosphere.

It has been proposed to mount the high pressure pump directly in the vapor separator so as to cool and silence the high pressure pump. This also reduces the necessity of having external conduits between the vapor separator and the high pressure pump. Frequently, the pressure regulation of the fuel is accomplished by dumping fuel from the fuel rail that supplies the fuel injectors back to the vapor separator.

With the previously proposed types of arrangements, the vapor separate has been comprised of an outer housing and certain of the contained components extend through this outer housing and particularly an upper wall member thereof. For example, it has been the practice to provide the high pressure pump in such a way that a portion of the pump extends through the cover of the fuel vapor separator. This provides areas where fuel may leak.

These problems are particularly significant in conjunction with the use of fuel injection systems for outboard motors. With an outboard motor, it is important that the overall construction be compact. In addition, however, the components should be located in such a way that the fuel will not be unduly heated by the heat from the adjacent engine. Finally, outboard motors have a problem which is unique, in that the outboard motor may be operated in varying trim conditions and may, at times, be titled up to an out-of-the-water condition. Under these varying conditions, the level of fuel in the vapor separator will vary, and it is important to ensure that fuel cannot leak from the vapor separator, either through the cover arrangement or through the conduits connecting it to the various components under these conditions.

It is, therefore, a principal object of this invention to provide an improved fuel vapor separator for an engine.

It is a further object of this invention to provide a fuel vapor separator particularly adapted for use with outboard motors wherein leakage is prevented.

It is a further object of this invention to provide an improved construction for a fuel vapor separator for an outboard motor wherein the conduits can be easily connected to the fuel vapor separator and none of the internal components of the fuel vapor separator are exposed.

It is a further object of this invention to provide an improved lay out for the components of a fuel injection system for an outboard motor wherein a compact yet serviceable arrangement results.

As has been noted, the practice has been to provide fuel to the fuel injectors of the engine through a fuel rail. Normally, the fuel rail has been attached to the fuel injectors through an elastic connection which provides sealing. However, the fuel rail itself has some weight, and unless rigidly connected, there may be a possibility of leakage.

It is, therefore, a still further object of this invention to provide an improved arrangement and construction for connecting the fuel rail to the fuel injectors of an engine.

SUMMARY OF THE INVENTION

A first feature of this invention is adapted to be embodied in a fuel vapor separator and pumping arrangement for an internal combustion engine. The fuel vapor separator is comprised of an outer housing that consists of a main housing member and a cover plate that is detachably connected to the main housing member. A float operated valve is contained within the fuel vapor separator, and fuel is admitted to the fuel vapor separator through the float operated valve via an inlet conduit that is formed integrally with the cover plate. In addition, a fuel pump is contained within the housing assembly and has a discharge fitting that is in sealing engagement with a fitting formed on the cover for delivery of fuel to the engine. A vent or pressure relief line also communications with a fitting formed integrally with the cover for return of fuel from a pressure regulator to the fuel vapor separator cavity for separation of fuel vapors therefrom.

Another feature of the invention is adapted to be embodied in conjunction with an outboard motor having a power head in which an internal combustion engine is positioned. The engine is provided with a fuel injection system that includes a plurality of fuel injectors disposed on one side of the engine. A fuel rail is affixed to those fuel injectors on that one side of the engine. On the other side of the engine, there is provided a fuel vapor separator having an internal cavity in which fuel and vapor are stored and separated. Conduit means interconnect the fuel vapor separator with the fuel rail for exchange of fuel therebetween.

In accordance with an important feature embodying the foregoing construction, the fuel rail extends in a vertical direction and a return conduit extends from the upper end of the fuel rail to the fuel vapor separator for returning fuel and vapors to the fuel vapor separator.

A still further feature of the invention is adapted to be embodied in a fuel injection system for an internal combustion engine having a plurality of throttle bodies, each having an induction passage formed therein. The throttle bodies have receptive openings for receiving the nozzle portions of fuel injectors for supplying fuel to the induction passage. The throttle bodies have an upstanding boss portions formed on one side of the fuel injectors. A fuel rail is detachably connected to the fuel injectors for supplying fuel thereto. Means rigidly affix the fuel rail to the upstanding bosses of the throttle bodies.

BRIEF DESCRIPTION OF THE INVENTION

DETAILED DESCRIPTION OF THE PREFERRED EMBODIMENTS OF THE INVENTION

Figure 1:
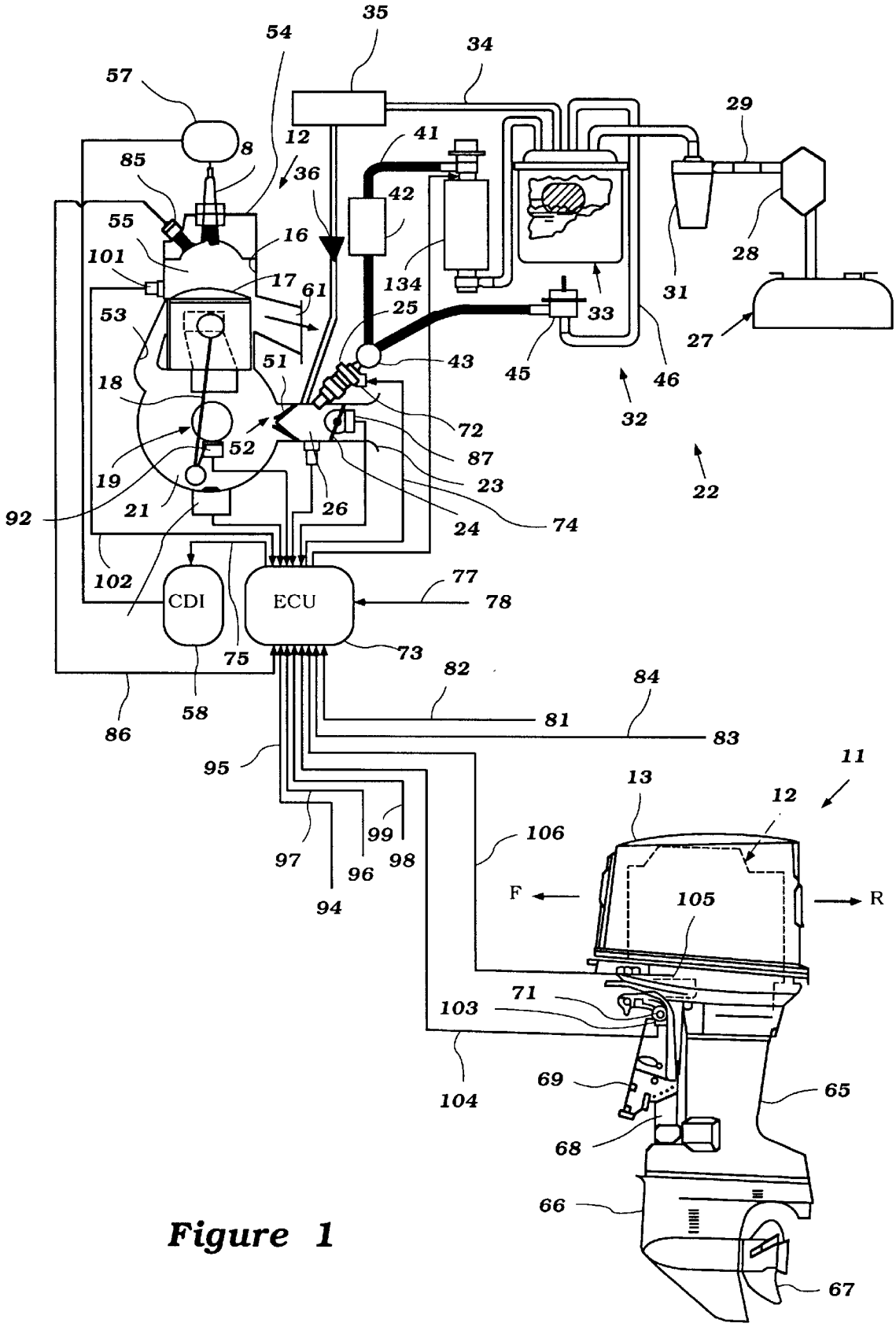
FIG. 1 is a composite view comprised of a side elevational view of an outboard motor embodying the invention and a schematic cross sectional view of the outboard motor's engine and its charge forming and ignition systems and their controls.

Referring now in detail to the drawings and initially to FIG. 1, an outboard motor is identified generally by the reference numeral 11. This view is composite view showing the complete outboard motor 11 in side elevation in a fully trimmed down position, and schematically with a single cylinder of the powering internal combustion engine is shown in cross section. The engine is identified generally with the reference numeral 12 and the associated fuel injection system for it shown partially in cross section and partially schematically.

The invention is described in conjunction with an outboard motor only as a typical environment in which the invention may be practiced. The invention has particular utility with two cycle crankcase compression internal combustion engines and since such engines are frequently employed as the powerplant for outboard motors, an outboard motor is a typical environment in which the invention may be employed.

The outboard motor 11, as already noted, includes a powering internal combustion engine 12 which, in the illustrated embodiment, is comprised of a two stroke six cylinder V type configuration. It will readily apparent to those skilled in the art how the invention can be employed in conjunction of other configurations and that certain facets of the invention may be utilized with four cycle engines.

Figure 2:
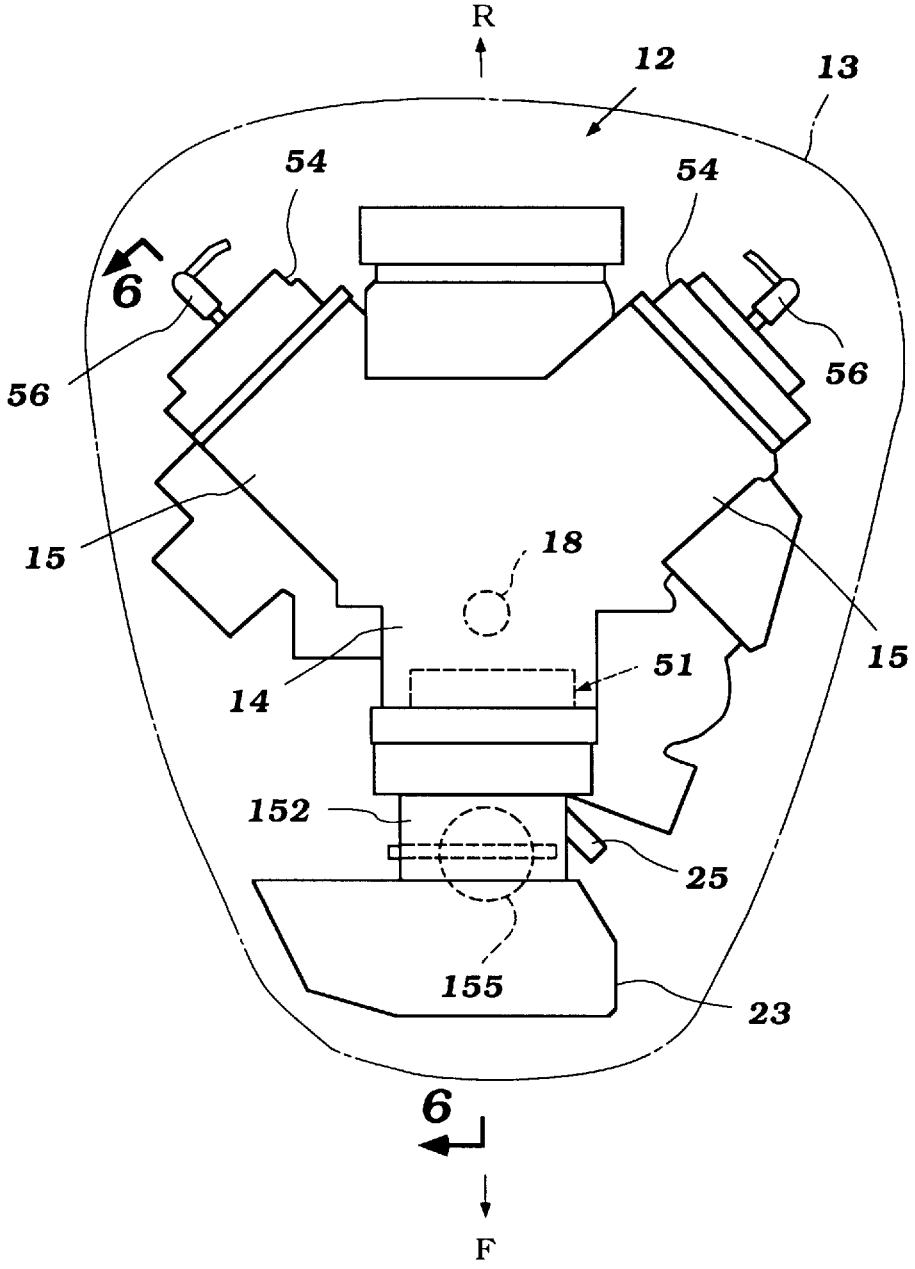
FIG. 2 is a top view of the power head with the protective cowling shown in phantom and showing the general layout of the engine.
Figure 3:
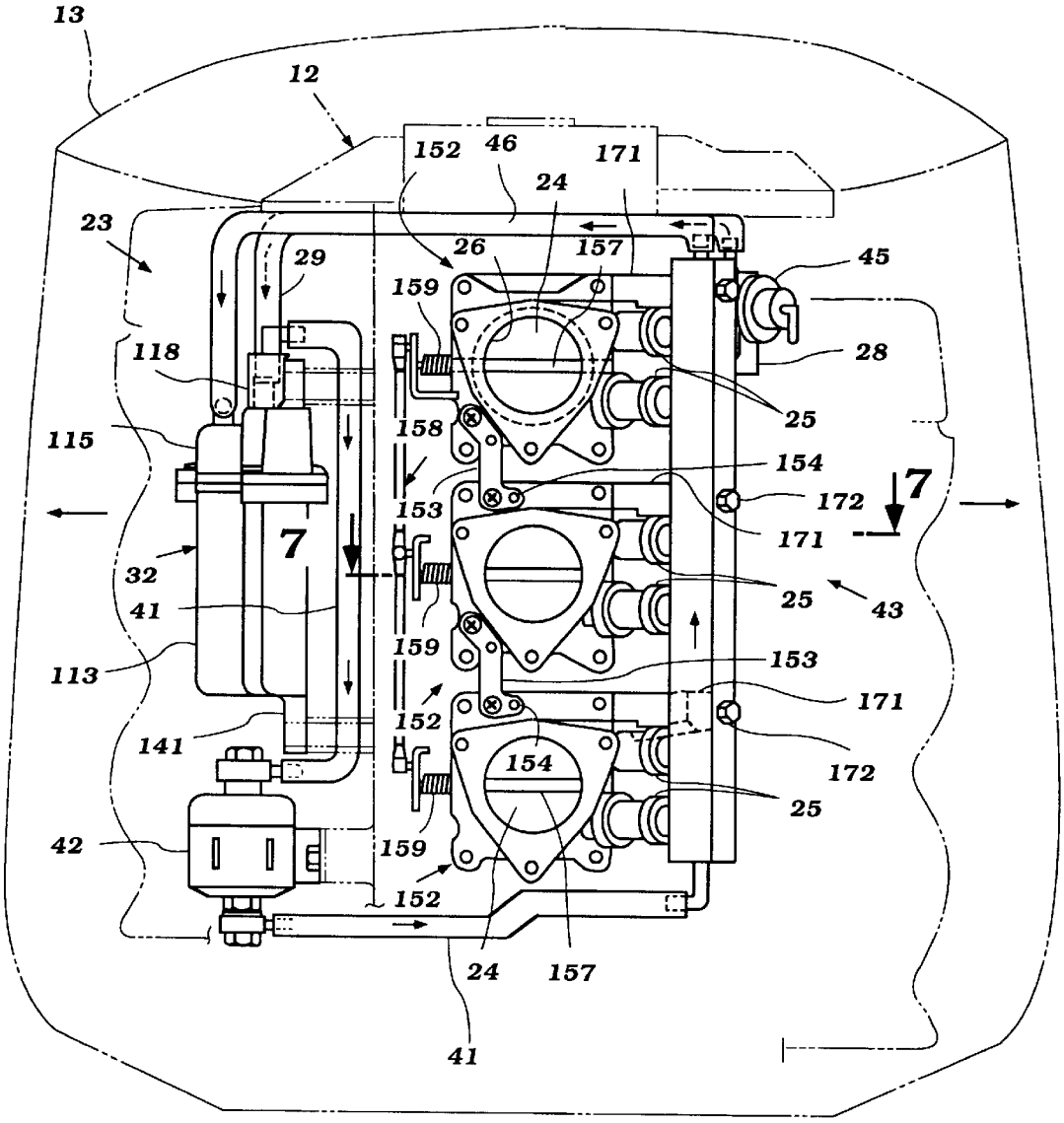
FIG. 3 is a front elevational view of the power head of the power head with the protective cowling and inlet device shown in phantom.
Figure 4:
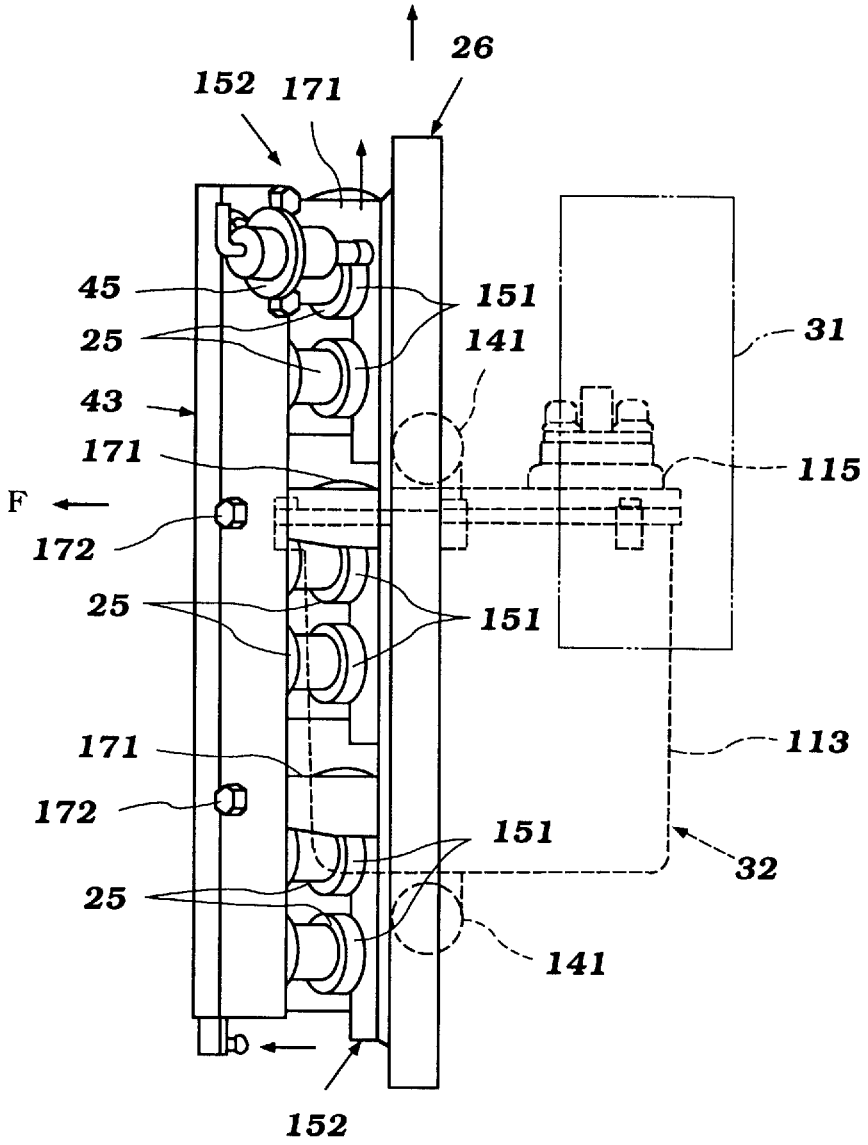
FIG. 4 is an enlarged side elevational view of the fuel rail, fuel injectors and throttle bodies with the vapor separator and fuel filter shown in phantom.
Figure 5:
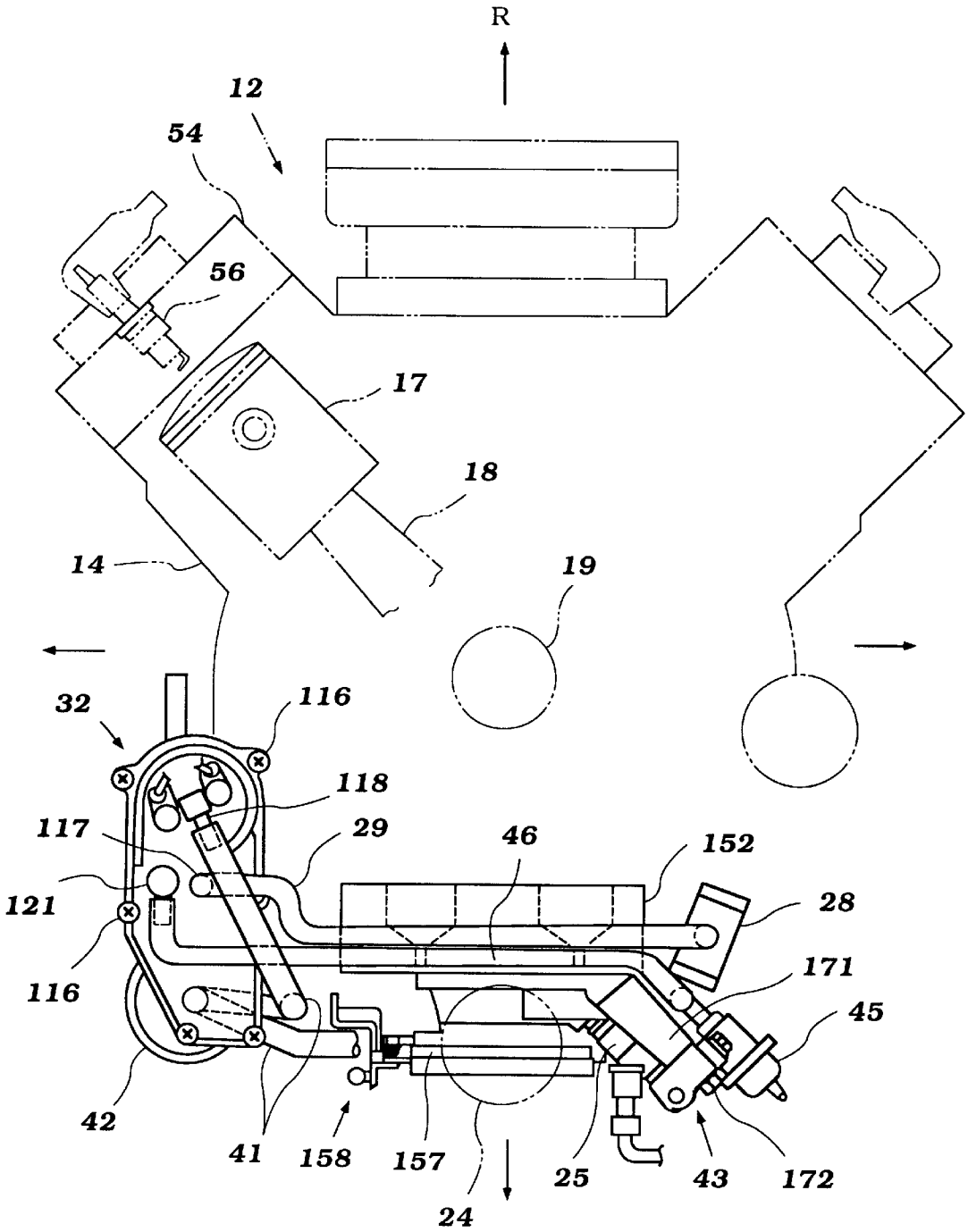
FIG. 5 is a top view of the fuel vapor separator system showing the remainder of the engine in phantom.
Figure 6:
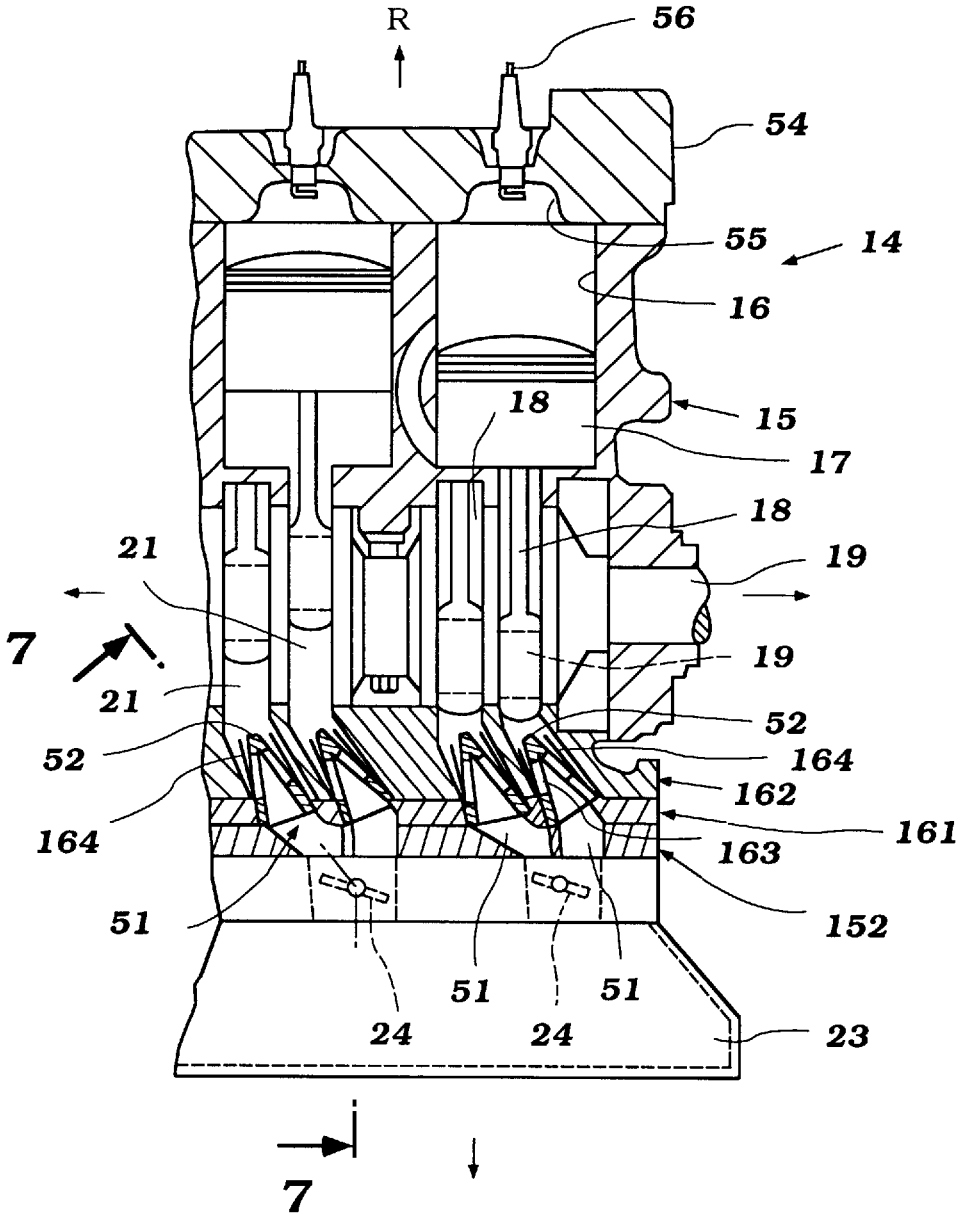
FIG. 6 is a cross sectional view taken along the line 6—6 of FIG. 2.
Figure 7:
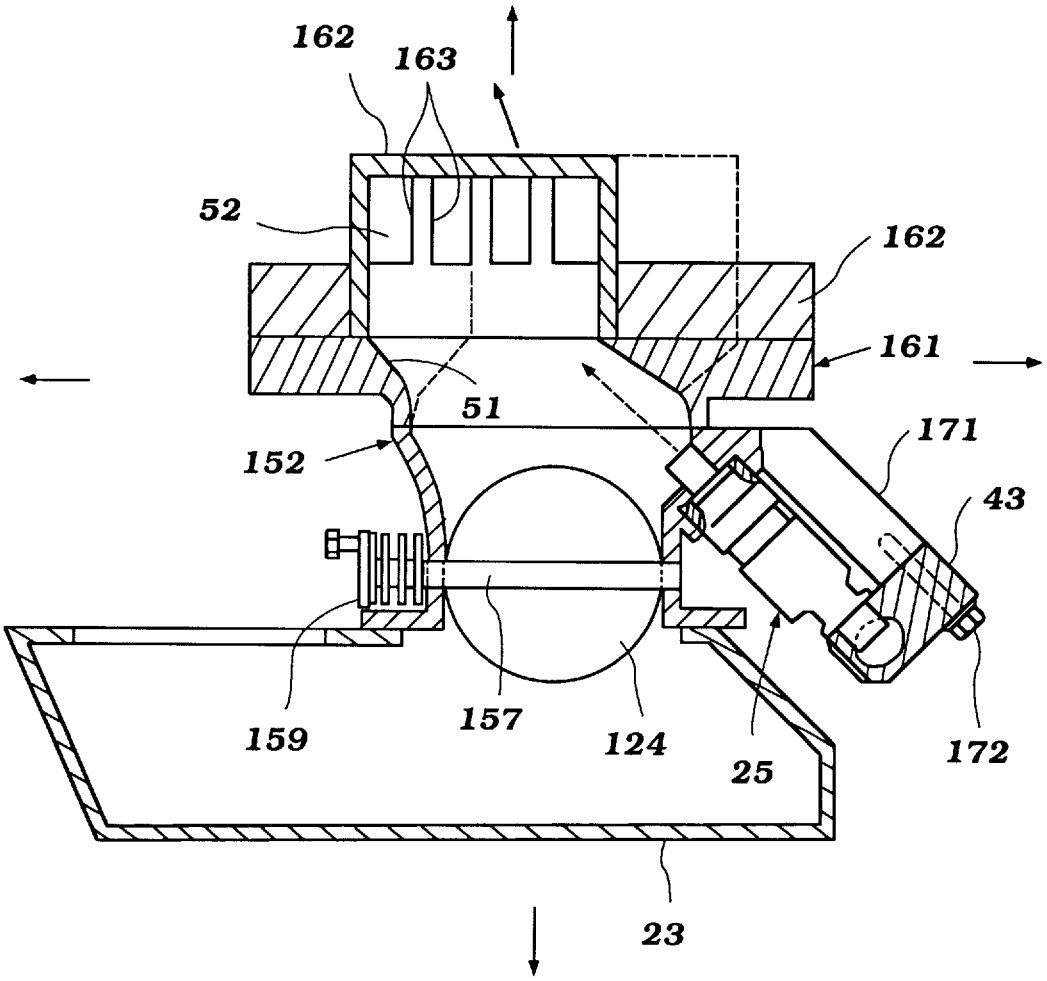
FIG. 7 is a cross section of the throttle body taken along the line 7—7 of FIGS. 3 and 6 with the air inlet device shown attached.

The engine 12 forms a portion of the power head of the outboard motor and this power head is completed by a protective cowling 13 which surrounds the engine 12 in a known manner. As may be seen in FIGS. 1 and 2, the engine 12 is composed of a cylinder block 14 with two vertically aligned cylinder banks 15 in which three aligned cylinder bores 16 are formed. Pistons 17 reciprocate in the cylinder bores 16 and are connected to connecting rods 18 which, in turn, drive a crankshaft 19 in a well known manner. The crankshaft 19 is rotatably journaled within a crankcase assembly which is divided into individual chambers 21 each associated with a respective one of the cylinder bores 16 and which are sealed from each other in a manner well known in this art.

A fuel/air charge is delivered to the crankcase chambers 21 by an induction system, indicated generally by the reference numeral 22, and which will be described in more detail later by reference to FIGS. 3–9 where the components are shown in full detail. Shown schematically this induction system includes an atmospheric air inlet device 23 that supplies a plurality of manually operated throttle valves 24. Electronically operated fuel injectors 25 spray fuel into an intake manifold 26 downstream of the throttle valves 24. The fuel injectors 25 receive fuel from a fuel system including a remotely positioned fuel tank 27. Fuel is drawn from a fuel tank 27 by means of a low pressure pump 28, through a conduit 29 in which a fuel filter 31 is positioned. This fuel is then delivered to a vapor separator assembly 32. The vapor separator 32 removes any air or fuel vapors by venting them to the intake manifold 23 through conduit 34, in which are positioned a filter canister 35 and one way check valve 36 which prevents a reverse gas flow from the intake manifold 23 to the vapor separator assembly 32.

From the vapor separator 32 the fuel is delivered through conduit 41, in which a fuel filter 42 is positioned and then to the fuel rail 43 which is in communication with a pressure regulator 45. The pressure regulator 45 maintains the desired pressure in the fuel rail 43 by bypassing excess fuel back to the vapor separator 32 through a return conduit 46. The operation of the vapor separator 32 and the fuel rail 43 will be described in more detail later.

The intake manifold 26 delivers air to the intake ports 51 of the engine 12 through reed type check valves 52 which operate to preclude reverse flow. The induced charge is drawn into the crankcase chambers 21 upon upward movement of the pistons 17 and then is compressed upon downward movement. The compressed charge is then transferred to the area above the pistons 17 through one or more transfer ports 53 in a manner well known in this art.

Cylinder heads 54 are affixed, one to each engine bank 15, in a known manner and define recesses which form part of the combustion chambers 55. A spark plug 56 is mounted in each cylinder recess and is fired by the ignition system in a known manner. The ignition system is comprised of a spark coil 57 for each cylinder and a controlling capacitor discharge ignition system (CDI) 58.

The cylinder block 14 is formed with an exhaust port 61 for each cylinder which communicates with an exhaust manifold (not shown).

As is typical with outboard motor practice, the cylinder block 14 and cylinder heads 54 are formed with cooling jackets through which coolant is circulated from the body of water in which the outboard motor 11 is operating in any conventional manner.

A driveshaft housing 65 depends from the power head and rotatably journals a driveshaft which is driven by the engine crankshaft 19 in a known manner. The driveshaft housing 65 is formed with an internal expansion chamber (not shown) to which exhaust gases are delivered from the manifold (not shown) by an exhaust pipe (not shown). Any suitable internal baffling and cooling system is provided for the exhaust gases and they are then discharged through a conventional underwater high speed exhaust gas discharge, which may comprise an outlet formed in the lower unit 66 or in the hub of a propeller 67 driven by the driveshaft. In addition, an above the water, low speed gas discharge may be incorporated.

As is typical with outboard motor practice, a steering shaft (not shown) is connected to the driveshaft housing 65 in a known manner. This steering shaft is journaled for steering movement about a generally vertically extending steering axis within a swivel bracket 68. The swivel bracket 68 is, in turn, pivotally connected to a clamping bracket 69 for tilt and trim movement about a horizontally disposed axis by a pivot pin 71. The lower right hand side view of FIG. 1 shows the outboard motor 11 in a fully trimmed down position. The trim may be adjusted in any known manner. Also, the pivotal connection 71 permits the outboard motor 11 to be tilted up out of the water when not in use.

Referring now in more detail to the fuel injection system and the control therefor, as previously noted, the fuel injectors 25 are electronically controlled. To this end, each injector 25 is provided with an electrical terminal 72 that receives an output control signal from an ECU 73, through a conductor indicated by the line 74. A solenoid of the fuel injectors 25 is energized when the ECU 73 outputs a signal to the terminal 73 through the line 74 to open an injection valve and initiate injection. Once this signal is terminated, injection will also be terminated. The injectors 25 may be of any known type and in addition to a pure fuel injectors may compromise an air/fuel injectors.

The ECU 73 also controls the spark timing by signals sent to the CDI unit through conductors indicated schematically at 75.

A number of ambient atmospheric conditions are supplied to the ECU 73 and certain engine running conditions are supplied to the ECU 73 so as to determine the amount of fuel injected and the timing of the fuel injection. These ambient conditions may comprise atmospheric pressure which is measured in any suitable manner by a sensor 81 and which signal is transmitted to the ECU 73 through a conductor 82, temperature of the intake cooling water which is delivered to the engine cooling jacket from the body of water in which the watercraft is operating as sensed by an appropriate sensor 83 and transmitted through to the ECU 73 through a conductor 84. Additional ambient conditions may be measured and employed so as to provide more accurate control of the fuel injection, if desired.

There are also provided a number of engine condition sensors which sense the following engine conditions. An in-cylinder pressure sensor 85 senses the pressure within the cylinder and outputs this signal to the ECU 73 through a conductor 86. A throttle valve position sensor 87 senses the position of the throttle valves 24 and outputs this signal to the ECU 73 through a conductor 88. This signal is then compared to a signal received by the ECU 73 through conductor 77 from the cam member 78 which operates the throttle valve 24 and whose signal will differ with that from the throttle valve position sensor 87 in those situations where the cam member 78 has initiated acceleration but the throttle valve has yet to begin movement in response to the operation of cam member 78. Crankcase pressure is sensed by a pressure sensor 89 which is also mounted in the crankcase chamber 21 and outputs its signal to the ECU 73 through a conductor 91. Crank angle position indicative of the angular position and rotating speed of the crankshaft 19 is determined by a sensor 92 and outputted to the ECU 73 through a conductor 93. Engine temperature is sensed by a sensor 94 mounted in the cylinder block 14 and inputted to the ECU 73 through a conductor 95. Exhaust system back pressure in the expansion chamber (not shown) is sensed by a sensor 96 and is outputted to the ECU 73 through a conductor 97. The air to fuel ratio is measured by an oxygen sensor 98 and is outputted to the ECU 73 through a conductor 99. Engine knock is sensed by an engine knock sensor 101 mounted in the cylinder block 14 and inputted to the ECU 73 through a conductor 102.

In addition to these engine conditions, certain conditions of the outboard motor 11 are sensed. A trim condition sensor 103 outputs a signal indicative of the trim angle to the ECU 73 through a conductor 104. Finally, a transmission sensor 105 senses whether the outboard motor is in a neutral or drive condition and outputs a signal to the ECU 73 through a conductor 106. As with the ambient conditions, additional engine running conditions or outboard motor conditions may be sensed. Those skilled in the art can readily determine how such other ambient or running conditions can be sensed and fed to the ECU 73 to determine the fuel injection supply both in timing and amount.

As is disclosed in co-pending application, entitled "Feedback Control System For Marine Propulsion Engine", application Ser. No. 08/402,193, filed Mar. 10, 1995, which is assigned to the Assignee hereof, the ECU 73 may be programmed to provide a feedback control system based upon the output of the ambient condition sensors and engine running condition sensors in order to provide the ideal air fuel ratio and spark timing for each individual cylinder of the engine 12. Generally, the system is designed to maintain a stoichiometric mixture where actual air fuel ratio divided by stoichiometric is equal to 1.

Figure 8:
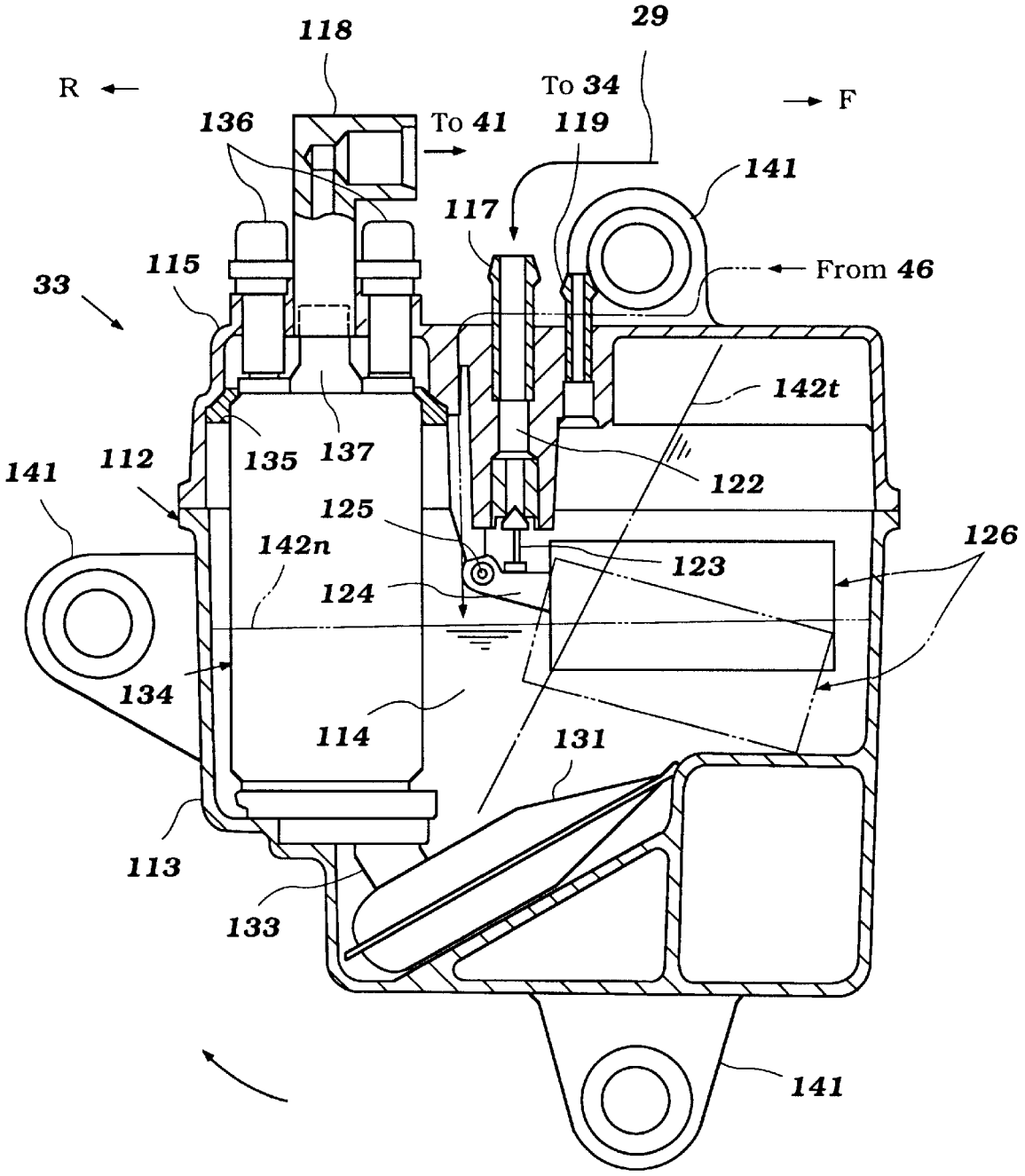
FIG. 8 is an enlarged vertical cross sectional view of the vapor separator.
Figure 9:
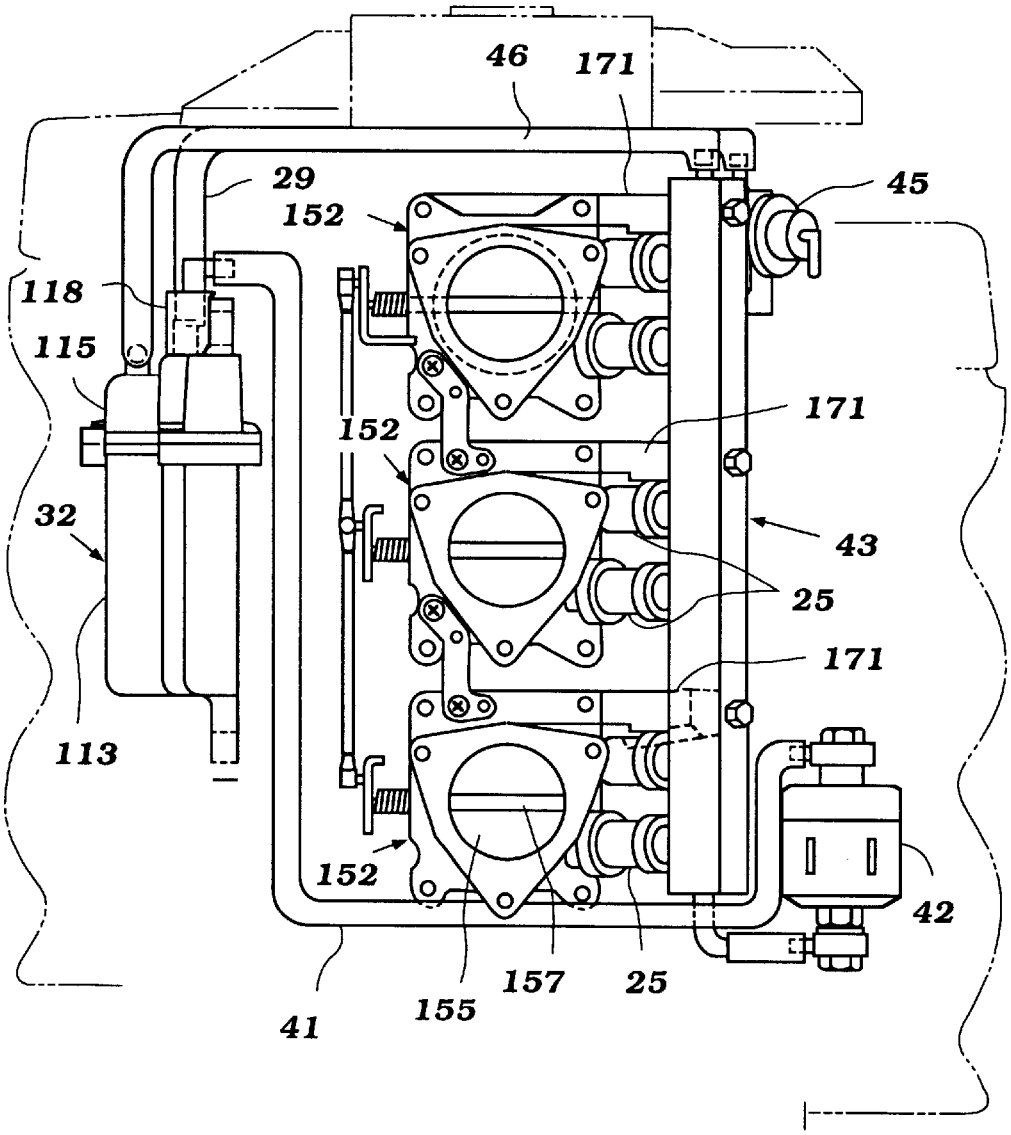
FIG. 9 is a front elevational view, in part similar to FIG. 3, and shows another embodiment of the invention.

Referring now to the fuel delivery system and first the vapor separator assembly 32, which is shown in most detail in FIG. 8, it consists of an outer housing assembly 112 composed of a main housing member 113 forming an internal cavity 114 which is detachably connected at its upper end to a cover plate 115 by the cover bolts 116. Integrally formed with the cover plate 115 are a fuel inlet fitting 117 that communicates with the conduit 29, aforementioned, a fuel outlet fitting 118, which communicated with the conduit 41, a vent fitting 119, which communicates with the conduit 41 and the return fuel fitting 121 (shown in FIG. 5) which communicates with the conduit 39.

Fuel enters the fuel inlet fitting 117 which sealingly engages fuel inlet conduit 29 and passes through the vertical passage 122 and to a float operated needle valve 123. The needle R valve 123 is slidably supported in passage 122 and connected at its lower end to arm 124 which, in turn, is pivotally mounted to the cover plate 115 by pin 125 at the forward end. The rear end carries a float 126 at the rearward end. The float 126 determines at what level the fuel, supplied through inlet passage 122, will be maintained in the internal cavity 114. If the fuel level is too low the float 126 will drop in the internal cavity 114 and therefore open valve 123 such that fuel is able to flow past the valve 123, filling the internal cavity 114 until such time as the fuel level raises the float 126 to a position at which the valve 123 has been raised enough to effectively seal the inlet passage 122, thus discontinuing the flow of fuel to the internal cavity 114.

A strainer 131 draws fuel from the vapor separator internal cavity 114. The strainer 131 supplies a fuel pump conduit 133 which, in turn, sealingly engages the lower end of a high pressure fuel pump 134. The high pressure fuel pump 134 is an immersion type fuel pump supported at its lower end in the lower portion of the main housing member 113. The upper side of the high pressure fuel pump 134 sealingly engages an O-ring seal 135 which is pressed against the lower surface of the cover plate 115 providing a leak-proof seal at the opening of the cover plate 115.

Positioned at the top of the high pressure fuel pump 134 are two terminals 136 for supplying electrical power to the pump 134, and a fuel pump discharge fitting 137 which is in fluid communication with and sealingly engages the cover plate fuel outlet fitting 118.

The vapor separator assembly 33 is rigidly connected to one side of the front of the engine 12 by a mounting bracket 141. In the normal orientation of the vapor separator assembly 33 when the outboard motor 11 is in its trim down conditions, the fuel level will be relatively parallel to the upper wall of the cover 115 as shown by the line 142*n*. When, however, the outboard motor 11 is fully tilted up, the fuel level will shift to the position shown by the line 142*t*. It will be noted that even though the fuel shifts significantly in the cavity 114, it will not reach any of the conduits and specifically the fittings 119 and 117 and fuel will not tend to leak back out of the vapor separator.

When fuel is delivered to the cavity 114, any fuel vapors or air will rise above this level and enter the vent passage for discharge into the engine induction system where the hydrocarbons will be burned as previously described.

Referring to the fuel rail 43, which is shown in most detail in FIGS. 3, 4, 7, and 9, it is positioned on the side of the engine 12 opposite to the vapor separator assembly 32 and aligned with the vertical axis. The six fuel injectors 25 have detachable connections at their supply ends to the fuel rail 43. The nozzle portions of the injectors 25 are sealingly connected at their forward ends to receptive openings 151 in the three throttle bodies 152 in which the throttle valves 24, previously referred to in the schematic view of FIG. 1 are positioned. The throttle bodies 152 are aligned with the vertical axis and held in a vertical spacing arrangement with each other by the fixing plates 153 which are rigidly constrained at the positioning pins 154. Throttle valves 24 are journaled in the throttle bodies by means of the throttle shafts 157. The position of the throttle valves 24 is synchronized by a linkage 158, which is connected to each throttle shaft 157. The throttle valves 24 are urged to a closed position by springs.

Affixed to the throttle bodies 152 at their forward end and defining the intake port 51 are valve plate 161 and caging member 162, which is carried by the valve plate. Caging member 162 provides openings 163 to each individual crankcase chamber 21 that are sealed by the reed valves 52. Reed valves 52 are attached to the caging member 162 forward of openings 163 and seat said openings. During a cylinder intake stroke the pressure induced by the upward motion of piston 17 unseat the reed valves 52 and force them back against stopper plates 164 exposing openings 163 and allowing an influx of air fuel mixture past the valves 52 and into the crankcase 21. The ensuing downward motion of the piston 17 during the compression stroke generates a negative pressure wave that seats the reed valves 52 to the openings 163 thus inhibiting reverse flow of the air fuel mixture from the crankcase 21 back into the throttle body 152.

Bosses 171 extend from the throttle bodies 152 and are rigidly connected to the fuel rail 43 by means which include the bolts 172. This arrangement allows the weight of the fuel rail 43 to be loaded directly through the bosses 172 into the throttle bodies 152 instead of into the fuel injectors 25 thus eliminating the possibility of leaks developing at the elastic connection between the fuel injectors 25 and the fuel rail 43 due to the weight of the fuel rail 43 loading the connection.

Sealingly connected to the fuel rail 43 at its lower end is the conduit 41 in which is positioned the fuel filter 42 which may be mounted to either the left or the right hand side of the engine 12. Fuel is supplied from the vapor separator assembly 32 through conduit 41 to the fuel rail 43. At its upper end the rail 43 is in sealing engagement with the pressure regulator 45 which, in turn, sealingly engages the vapor separator assembly 32 through the return conduit 46.

This layout offers several advantages in that as the fuel rail 43 is aligned vertically, with the fuel supply entering from its lower end, it is apparent that any air or vapor present in the fuel supply will tend to rise up to the top of the fuel rail 43 and into the return conduit 46 and not into the fuel injectors 25 where its presence would compromise the ideal stoichiometric air fuel mixture for combustion as determined by the ECU 73. Also, as may best be seen in FIG. 5, the layout of the conduits which engage the fuel rail 43 and pressure regulator 46 on the right hand side of the engine 12 to the vapor separator assembly 32 on the left hand side of the engine 12 is such that the conduits are not only accessible and easily serviceable but are also located as far away as possible from the higher temperature regions of the engine 12 thus minimizing the risk of the conduits being damaged by the heat generated by the engine 12.

It should be readily apparent from the foregoing description that the desired embodiments are very effective in meeting the objects as set forth. Of course, various changes and modifications may be made without departing from the spirit and scope of the invention, as defined by the appended claims.

What is claimed is:

1. An outboard motor having a power head containing an internal combustion engine having a fuel feed system including a fuel vapor separator and a protective cowling surrounding said internal combustion engine and said fuel vapor separator, said outboard motor being pivotal about a forwardly disposed, horizontally extending axis for tilt and trim operation, said fuel vapor separator being disposed relatively close to said horizontal pivotal axis for minimizing the effect of variations in fuel level in response to trimming of the outboard motor, said fuel vapor separator being comprised of an outer housing consisting of a main body portion forming an internal cavity and a cover affixed to and closing said cavity, said cover forming an integral fuel inlet fitting, an integral fuel outlet fitting and an atmospheric vent fitting, and wherein said cavity is oriented relative to said fuel inlet fitting, said fuel outlet fitting, and said atmospheric vent fitting so that when the outboard motor is tilted up, the fuel level will not reach said fittings.

2. An outboard motor as set forth in claim 1, further including a return fuel inlet fitting formed integrally in said cover for receiving fuel from a pressure regulator of the associated fuel injection system.

3. An outboard motor as set forth in claim 1, further including a fuel pump contained within said cavity for pumping fuel from said cavity to a fuel pump discharge fitting, said fuel pump discharge fitting being in fluid communication with said fuel outlet fitting of said cover.

4. An outboard motor as set forth in claim 3, wherein the fuel inlet fitting communicates with the cavity of said fuel vapor separator through a float operated valve.

5. An outboard motor as set forth in claim 4, further including a return fuel inlet fitting formed integrally in said cover for receiving fuel from a pressure regulator of the associated fuel injection system.

6. An outboard motor as set forth in claim 1, wherein the engine has a plurality of vertically spaced cylinders and has its output shaft rotating about a vertically extending axis.

7. An outboard motor as set forth in claim 6, wherein the fuel injection system comprises a plurality of vertically spaced throttle bodies for supplying an air charge to the engine.

8. An outboard motor as set forth in claim 7, further including a plurality of fuel injectors mounted in said throttle body in an aligned array on a side of said throttle body opposite said fuel vapor separator.

9. An outboard motor as set forth in claim 8, further including a return fuel inlet fitting formed integrally in said cover for receiving fuel from a pressure regulator of the associated fuel injection system.

10. An outboard motor as set forth in claim 9, wherein there is provided a fuel pressure regulator on the same side of the engine as the fuel injectors for returning fuel to the fuel vapor separator through its fuel return fitting.

11. An outboard motor as set forth in claim 10, further including a vertically extended fuel rail for supplying fuel to the fuel injectors.

12. An outboard motor as set forth in claim 11, wherein the fuel pressure regulator is disposed at the top of the fuel rail and a return conduit extends across the top of the throttle bodies, and further including a supply conduit extending from the integral fuel outlet fitting of the fuel vapor separator across the lower portion of the throttle bodies and communicating with the fuel rail at the lower end thereof.

13. An outboard motor as set forth in claim 12, wherein the throttle bodies have outstanding bosses integrally formed therewith and further including fastening means for affixing the fuel rail directly to said bosses.

14. An outboard motor as set forth in claim 8, further including a fuel pump contained within said cavity for pumping fuel from said cavity to a fuel pump discharge fitting, said fuel pump discharge fitting being in fluid communication with said fuel outlet fitting of said cover.

15. An outboard motor as set forth in claim 14, wherein the fuel inlet fitting communicates with the cavity of said fuel vapor separator through a float operated valve.

16. An outboard motor as set forth in claim 15, further including a return fuel inlet fitting formed integrally in said cover for receiving fuel from a pressure regulator of the associated fuel injection system.

17. An outboard motor fuel supply system, said outboard motor being comprised of a multi-cylinder internal combustion engine and a surrounding protective cowling, said engine having its output shaft rotatable about a vertically extending axis, a plurality of throttle bodies affixed to said engine and vertically spaced array for admitting an air charge to said engine, a fuel vapor separator disposed on one side of said throttle bodies within said protective cowling and adapted to receive fuel from a fuel source, a plurality of fuel injectors for said engine all mounted in said throttle bodies in a vertically aligned array and all of which are disposed on the side of said throttle bodies opposite said fuel vapor separator, a fuel supply line for delivering fuel from said fuel vapor separator to said throttle bodies.

18. An outboard motor fuel supply system as set forth in claim 17, wherein there is provided a fuel pressure regulator on the same side of the engine as the fuel injectors for returning fuel to the fuel vapor separator through a fuel return fitting.

19. An outboard motor fuel supply system as set forth in claim 18, further including a vertically extended fuel rail for supplying fuel to the fuel injectors.

20. An outboard motor fuel supply system as set forth in claim 19, wherein the fuel pressure regulator is disposed at the top of the fuel rail and a return conduit extends across the top of the throttle bodies, and further including a supply conduit extending from an integral fuel outlet fitting of the fuel vapor separator across the lower portion of the throttle bodies and communicating with the fuel rail at the lower end thereof.

21. An outboard motor fuel supply system as set forth in claim 20, wherein the throttle bodies have outstanding bosses integrally formed therewith and further including fastening means for affixing the fuel rail directly to said bosses.

22. An outboard motor as set forth in claim 15, wherein the float operated valve includes a float pivotal about a horizontal extending axis that extends parallel to the horizontal axis of the outboard motor.

23. An outboard as set forth in claim 22, wherein the fittings are disposed to be disposed substantially to the rear of the float of the float operated valve for further assisting and ensuring that fuel cannot flow out of said fittings when said outboard motor tilted up.

* * * * *